US007874892B2

(12) United States Patent
Hippely

(10) Patent No.: US 7,874,892 B2
(45) Date of Patent: Jan. 25, 2011

(54) FLUID DRIVEN VEHICLE PLAYSET

(75) Inventor: Keith Alan Hippely, Manhattan Beach, CA (US)

(73) Assignee: Mattel, Inc., El Segundo, CA (US)

( * ) Notice: Subject to any disclaimer, the term of this patent is extended or adjusted under 35 U.S.C. 154(b) by 277 days.

(21) Appl. No.: 11/961,570

(22) Filed: Dec. 20, 2007

(65) Prior Publication Data

US 2009/0159063 A1 Jun. 25, 2009

(51) Int. Cl.
*A63H 29/00* (2006.01)
*A63H 27/14* (2006.01)

(52) U.S. Cl. ..... 446/429; 446/45; 446/63; 446/64; 446/198; 446/199; 446/230

(58) Field of Classification Search ..... 446/37, 446/45, 46, 48, 63, 64, 198, 199, 221, 230, 446/241, 255, 429, 212, 231, 473; 124/64, 124/63
See application file for complete search history.

(56) References Cited

U.S. PATENT DOCUMENTS

| | | | | |
|---|---|---|---|---|
| 561,944 | A | 6/1896 | Monnier | |
| 2,520,245 | A * | 8/1950 | Indehar | 446/205 |
| 2,640,296 | A | 6/1953 | Johnson et al. | |
| 2,993,297 | A * | 7/1961 | Bednar et al. | 446/197 |
| 3,080,859 | A | 3/1963 | Benkoe | |
| 3,109,256 | A | 11/1963 | Dean | |
| 3,121,292 | A * | 2/1964 | Butler et al. | 446/212 |
| 3,469,340 | A | 9/1969 | Breneman et al. | |
| 3,709,495 | A | 1/1973 | Krombein | |
| 3,740,896 | A * | 6/1973 | Glass et al. | 446/212 |
| 3,970,309 | A | 7/1976 | Sato | |
| 4,076,006 | A * | 2/1978 | Breslow et al. | 124/64 |
| 4,159,705 | A * | 7/1979 | Jacoby | 124/63 |
| 4,174,835 | A | 11/1979 | Breslow et al. | |
| 4,183,168 | A | 1/1980 | Ross | |
| 4,186,927 | A | 2/1980 | Breslow et al. | |
| 4,192,093 | A * | 3/1980 | Hamano | 446/427 |
| 4,209,937 | A * | 7/1980 | Witte | 446/63 |
| 4,213,268 | A | 7/1980 | Erickson et al. | |

(Continued)

FOREIGN PATENT DOCUMENTS

EP 0077438 A2 4/1983

(Continued)

*Primary Examiner*—Gene Kim
*Assistant Examiner*—Scott Young
(74) *Attorney, Agent, or Firm*—Edell, Shapiro & Finnan LLC

(57) ABSTRACT

A playset includes a launching device and one or more accessory toys. The launching device includes a launch tube and a bellows system operable to generate a flow of air through the launch tube. The accessory toys may include vehicles such as air-launched vehicles and surface-launched vehicles. Each accessory toy may include a port that receives the launch tube. In use, an accessory toy is mounted onto the launch tube and the bellows is compressed, causing the air to propel the vehicle into the air or along a surface. In another embodiment, the launch tube may include and interference assembly that selectively prohibits the mounting of an accessory toy onto the launch tube, or prevents the launching of accessory toys already mounted onto the tube. The launching device may further be incorporated into a carrying case or a transport vehicle toy.

19 Claims, 13 Drawing Sheets

U.S. PATENT DOCUMENTS 4,236,345 A * 12/1980 Inoue ..... 446/197
4,240,224 A 12/1980 Katzman et al.
4,292,755 A 10/1981 Houn
4,329,808 A * 5/1982 Rich et al. ..... 446/62
4,382,347 A 5/1983 Murakami
4,411,249 A * 10/1983 Fogarty et al. ..... 124/64
4,438,587 A * 3/1984 Marino ..... 446/202
4,513,967 A 4/1985 Halford et al.
4,605,230 A 8/1986 Halford et al.
4,737,135 A 4/1988 Johnson et al.
4,889,513 A 12/1989 Paddock
4,897,065 A * 1/1990 Fertig et al. ..... 446/63
4,925,188 A 5/1990 McKay et al.
4,979,922 A 12/1990 Clark
5,014,990 A 5/1991 Kaser et al.
5,188,557 A * 2/1993 Brown ..... 446/212
5,326,301 A 7/1994 Woodside
5,343,850 A * 9/1994 Steer ..... 124/64
5,372,367 A 12/1994 McKendrick
5,381,778 A 1/1995 D'Andrade et al.
5,471,968 A * 12/1995 Lee ..... 124/64
5,651,736 A 7/1997 Myers
5,839,940 A 11/1998 Ensmenger
6,109,613 A 8/2000 Crompton et al.
6,321,737 B1 * 11/2001 Johnson et al. ..... 124/73
6,322,417 B1 11/2001 Bass
6,383,052 B1 5/2002 McCarthy
6,839,699 B2 1/2005 Chan
6,899,586 B2 5/2005 Davis
7,077,359 B2 7/2006 Poesch et al.
7,160,171 B1 * 1/2007 Rehkemper et al. ..... 446/429
7,216,642 B2 5/2007 Poesch et al.
7,293,776 B2 11/2007 Fenwick
3,605,328 A1 2/2009 Kilroy, Jr.
2006/0089075 A1 4/2006 Windt
2006/0194504 A1 8/2006 Ragonetti et al.
2006/0225716 A1 10/2006 Lapointe

FOREIGN PATENT DOCUMENTS

WO 93/14848 8/1993
WO 9314848 A1 8/1993

* cited by examiner

55

FLUID DRIVEN VEHICLE PLAYSET

FIELD OF THE INVENTION

The present invention is directed toward a fluid-driven toy playset and, in particular, to a playset including a pneumatic launcher configured to selectively mate with toy accessories.

BACKGROUND OF THE INVENTION

Various types of toy launchers are known in the art. Many model rockets use self-propelled, solid fuel rocket engines to propel them into the air. Other launchers include pressure-propelled rocket launchers which typically generate a pressure pulse in a base, and transfer the pulse to an inert toy rocket to implement launch. Such a launch is typically accomplished by pressurized fluid, namely, air or water. Numerous designs of pressure-propelled rocket launchers have been suggested and implemented. Such pressurized launchers typically operate by release of pressurized water or pressurized air into a launch tube that extends into a hollow region of the toy rocket. Blatant misuse of pressure-propelled rocket launchers may have undesired results. For example, a child may be injured if a non-sanctioned vehicle is mounted onto the launching tube (i.e., a vehicle not safely designed for use with the launcher). Other injuries can arise when projectiles are inserted into to launch tube. Thus it would be advantageous to provide a playset including a safety mechanism to limit the types of vehicles that may be mounted onto the launch tube.

SUMMARY OF THE INVENTION

A playset includes a launching device and one or more accessory toys. The launching device includes a launch tube and a bellows system operable to generate a flow of air through the launch tube. The accessory toys may include vehicles such as air-launched vehicles and surface-launched vehicles. Each accessory toy may include a port adapted to mate with the launch tube. In operation, an accessory toy is mounted onto the launch tube and the bellows is compressed, causing the air to propel the vehicle into the air or along a surface. In another embodiment, the launch tube may include an interference assembly that selectively prohibits the mounting of an accessory toy onto the launch tube, or may prevent the launching of accessory toys already mounted onto the tube. In another embodiment, the launching device may be incorporated into a carrying case or a toy transport vehicle.

BRIEF DESCRIPTION OF THE DRAWINGS

FIG. 8A is a side view of the transport vehicle in its stowed position. FIG. 8B illustrates the transport vehicle in its deployed position. FIG. 8C illustrate the transport vehicle of FIG. 8A, with a side wall removed for clarity.

Like reference numerals have been used to identify like elements throughout this disclosure.

DETAILED DESCRIPTION OF THE INVENTION

Figure 1:
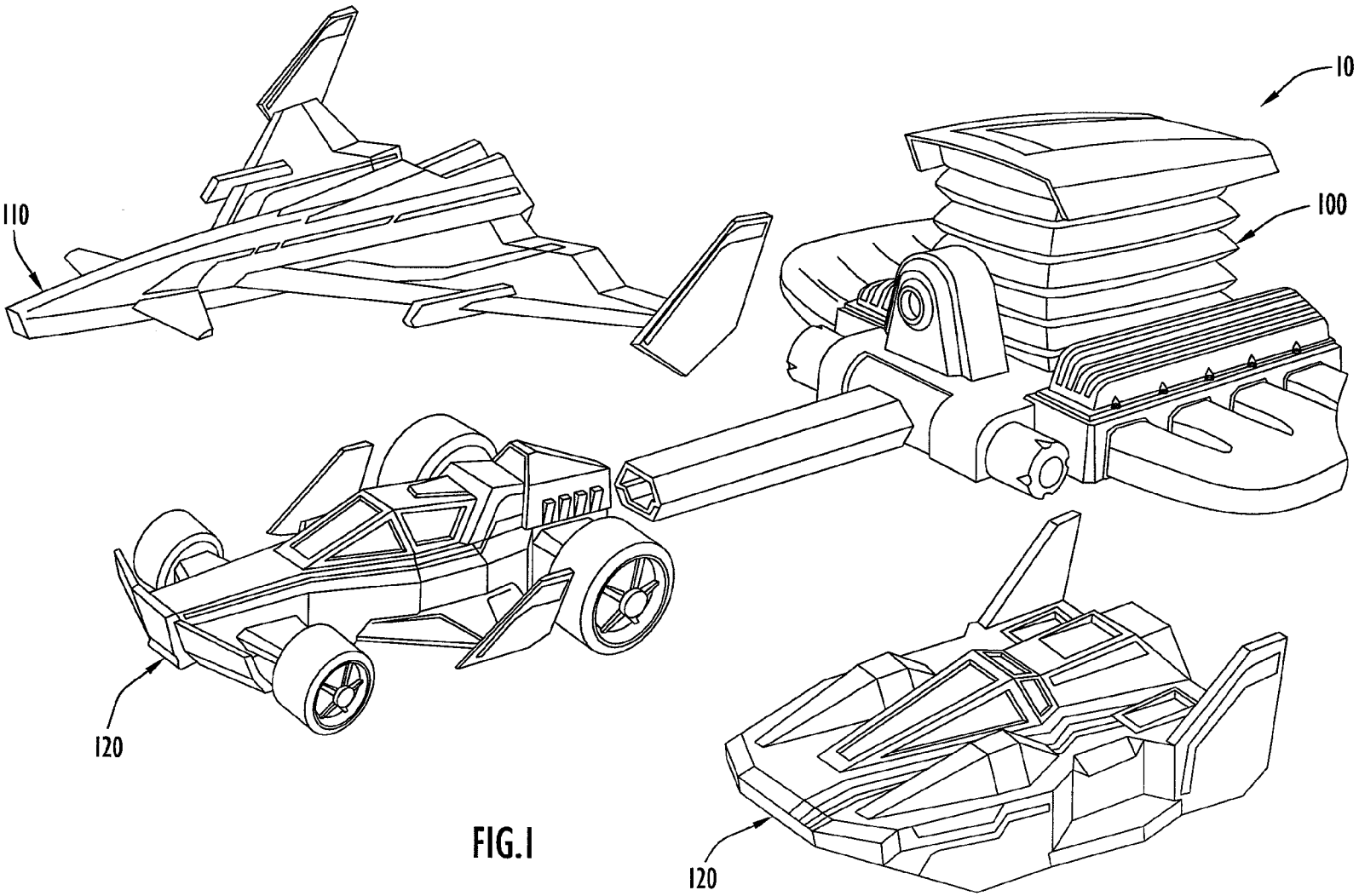
FIG. 1 illustrates a perspective view of a pneumatic toy playset in accordance with an embodiment of the present invention.
Figure 2A:
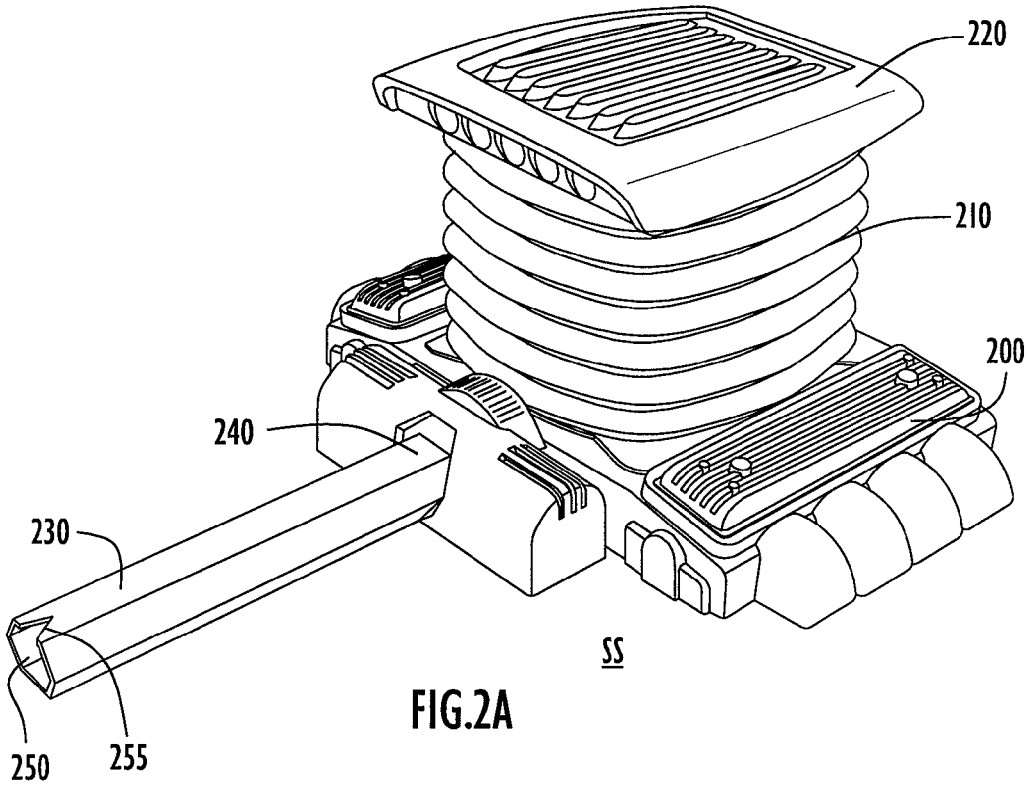
FIG. 2A illustrates an isolated, perspective view of a launching device in accordance with an embodiment of the present invention.

FIG. 1 is a perspective view of the playset in accordance with an embodiment of the present invention. As shown, the playset 10 may include launching device 100 and one or more accessories such as an air vehicle 110 and a surface vehicle 120. The launching device 100 may include any structure operable to generate a flow of fluid (e.g., air or water). By way of example, the launching device 100 may be a pneumatic device operable to generate a flow of air sufficient to propel an accessory vehicle 110, 120 into the air or along a surface. FIG. 2A is a perspective view of the launching device 100 in isolation. As shown, the launching device 100 includes a base portion 200, a bellows assembly 210 supported by the base portion 200, a cap portion 220 coupled to the bellows assembly 210, and a launch tube 230. The base 200 provides a stable support for the launching device 100 on a support surface SS. The bellows assembly 210 is collapsible towards the base 200, and thus is capable of generating a flow of fluid upon compression.

Figure 2B:
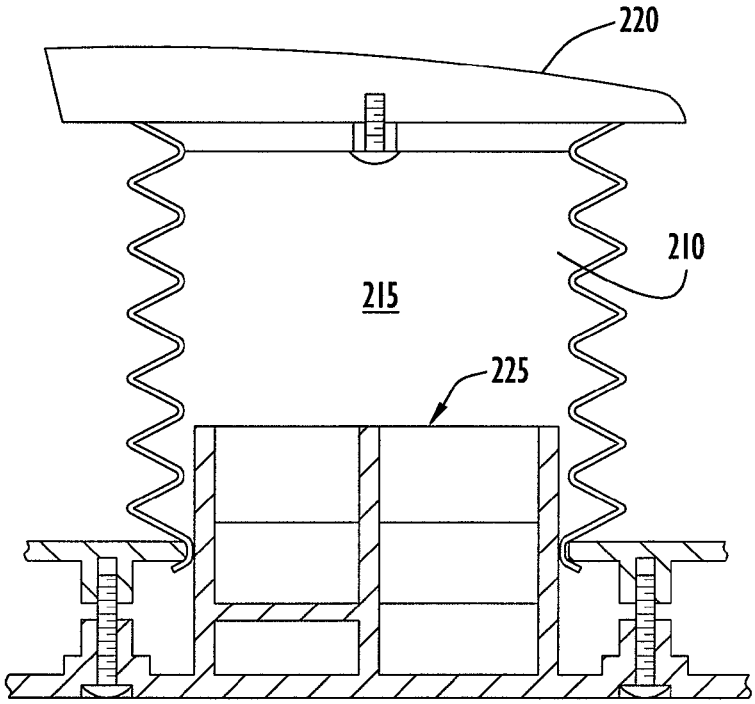
FIG. 2B illustrates a cross-sectional view of the launching device of FIG. 2A.
Figure 2C:
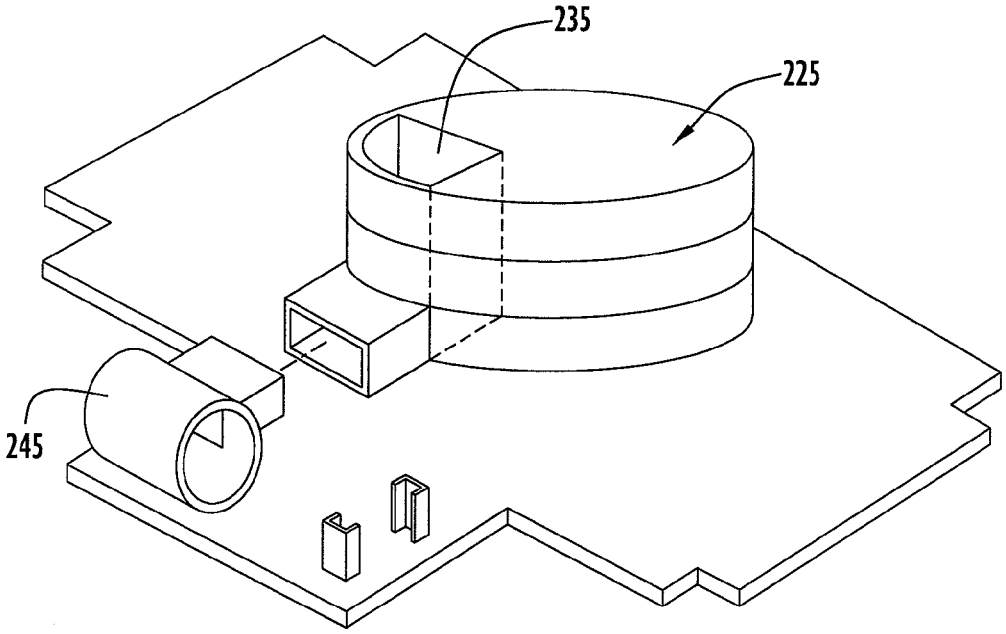
FIG. 2C illustrates the launching device of FIG. 2A, with the bellows and launch tube removed for clarity.

FIG. 2B is a cross sectional view of the launching device of FIG. 2A. As shown, the bellows 210 includes a hollow chamber 215 surrounding a fluid shaft assembly 225. FIG. 2C is an internal view of the launching device of FIG. 2A, with the bellows 210 and launch tube 230 removed for clarity. The shaft assembly 225 may include an L-shaped shaft 235 in fluid communication with the launch tube 230 via a connector 245. The shaft 235 directs fluid generated by the bellows 210 into connector 245 and, ultimately (via air passageways in the connector 245) into the launch tube 230.

The launch tube 230 defines a channel that permits passage of fluid therethrough. The launch tube 230 may possess any shape or have any suitable dimensions. By way of example the launch tube 230 may be contoured such that it is slidingly received by a connection port formed in the accessory vehicles 110, 120 (discussed in greater detail below). Referring back to FIG. 2A, the launch tube 230 may include a proximal end 240 coupled to the shaft assembly 235 (via the connector 245) and a distal end 250 including a notch or groove 255. Both the launch tube 230 and the bellows portion 210 are coupled to the base 200 via a fluid-tight seal. Consequently, compressing the bellows 210 generates a flow of air that is forced into the shaft assembly 225, through the shaft 235, into the proximal end 240 of the launch tube 230 and out through the distal end 250 of the launch tube 230.

Figure 2D:
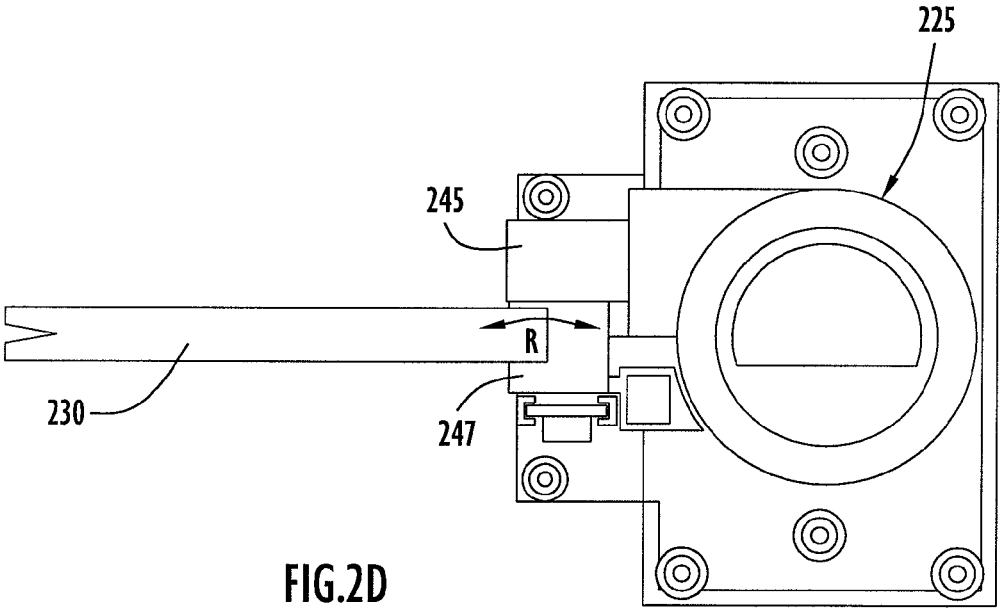
FIG. 2D illustrates a top plan view of launch tube and shaft assembly of the launching device showed in FIG. 2A.

The launch tube 230 may further be adapted to move with respect to the base 200 and/or supporting surface SS. FIG. 2D shows a top view of the shaft assembly 225, connector 245, and launch tube 230. The launch tube 230 may be moveably/slidably coupled to the connector 245 (indicated by arrow R) via tube post 247; consequently, the launch tube 230 may be reoriented from a first position, in which the launch tube 230 is generally horizontal (i.e., the tube is oriented generally parallel to the supporting surface SS) to second position, in which the tube is not horizontal (i.e., the tube is oriented at an angle with respect to the supporting surface SS). In the first (horizontal) position, an accessory vehicle (e.g., a surface vehicle 120) may launched onto the supporting surface SS, while in the second (angled) position, an accessory vehicle (e.g., an air vehicle 110) may be launched upward.

Figure 2E:
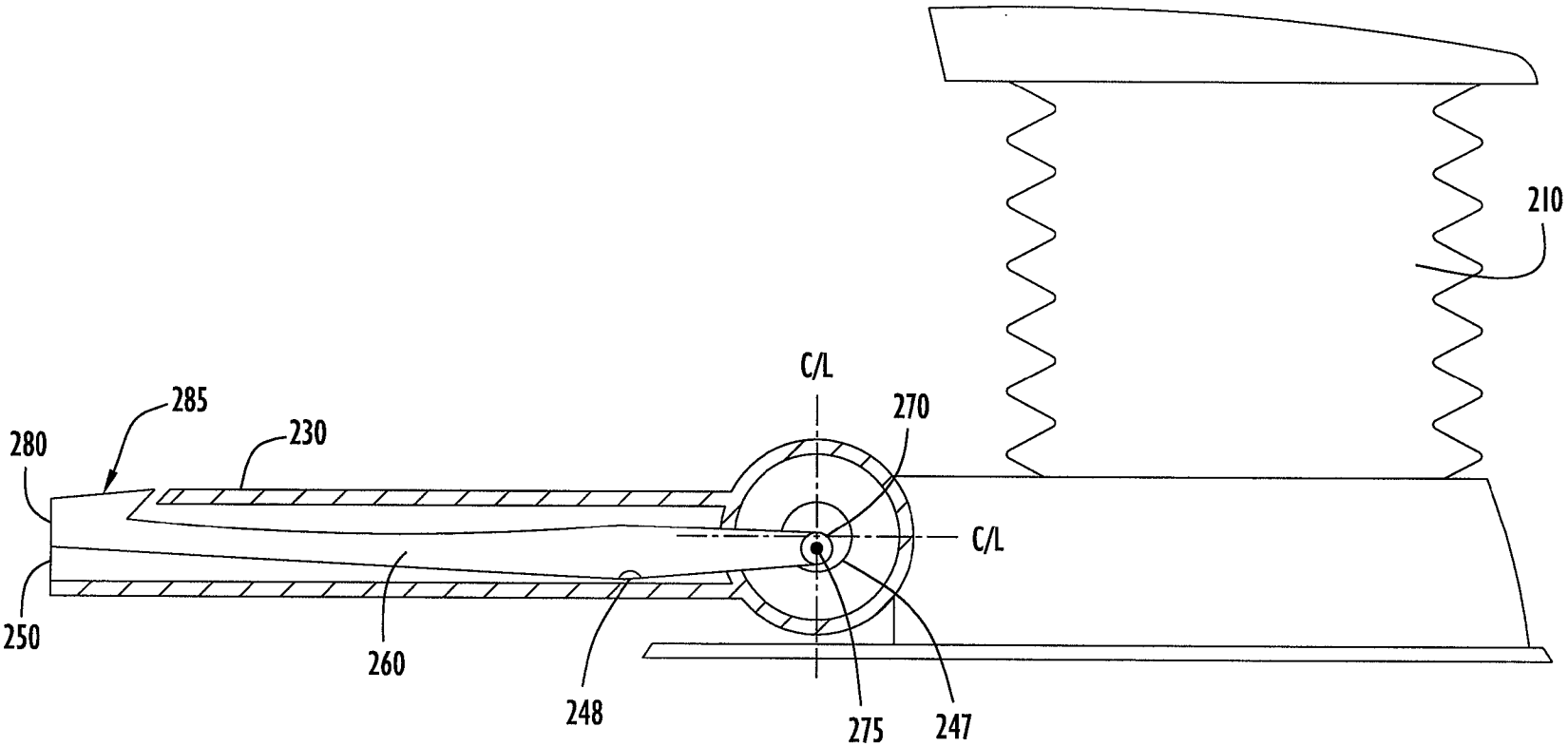
FIG. 2E illustrates a side view of the launching device of FIG. 2A, showing a cross-sectional view of the launch tube including an interference mechanism.

The launching device 100 may further be adapted to permit the selective mounting of a vehicle onto the launch tube 230. FIG. 2E is a side view of the launching device 100, showing an internal view of the launch tube 230. The launch tube 230 may include an interference mechanism configured to selectively prevent the mounting of certain ones of the accessory vehicles 110, 120 onto the launch tube 230. The interference mechanism includes an arm 260 having a proximal end 270 and a distal end 280. The proximal end 270 of the arm 260 may be coupled to the tube post 247 via an off-center pin 275. With this configuration, the interference arm 260 includes a proximal or rear pivot point, located about off-center pin 275, and a distal or forward pivot point 248, disposed along the arm 260. The rear pivot point of the interference arm 260, moreover, differs from the pivot of the launch tube 230. For example, the pivot point of the launch tube 230 may extend axially about the centerline of the tube post 247, while the rear pivot point (the pivot point of the interference arm 260) may extend axially about the off-center pin 275 mounted on tube post 247, which may be positioned just forward and below the centerline of tube post 247. With this configuration, as the launch tube 230 rotates, the off-center pin 275 pulls the proximal end 270 of arm 260 down and inward relative to tube 230, imparting rotational and sliding motion to the arm 260 relative to tube 230. Thus, the arm 260 is repositioned (pivoted) about forward pivot 248 with respect to the launch tube 230 (note the forward pivot 248 may slide a short distance on the inner lower surface of tube 230 as it pivots).

The distal end 280 of the arm 260 may include a hook or tab 285 configured to selectively extend from the notch 255 formed in the launch tube 230. As the arm 260 rotates/pivots within the launch tube 230, the interference tab 285 moves from a retracted position within the launch tube 230 to an extended position outside of the launch tube 230. Referring to FIGS. 3C and 3D, the tab 285 may include a proximal facing shoulder or ramp 252 configured to engage a complementary ramp 254 defined along the distal edge of the launch tube at the notch 255. Since, as explained above, the arm 260 moves its distal end 280 upward and inward (proximally), when the launch tube 230 is pivoted upward from the first position to the second position, the shoulder 252 moves inward to engage the notch ramp 254. Specifically, the tab 285 not only moves up, but also moves inward (indicated by arrow L) toward the proximal end 280 of the launch tube 230 so that the ramps 252, 254 engage each other. This engagement imparts a further upward force to the shoulder 252 and tab 285, which keeps the tab 285 (and thus the arm 260) from flexing downward. This is advantageous in the situation where a surface vehicle 120 is initially placed on the launch tube 230 oriented in the first position, and then the tube is moved upward to the second position. If this happens, the arm 260 engages the interior surface of the vehicle's launch tube connection port with a force sufficient to prevent the vehicle from launching. The additional lift provided by the engaging ramps 252, 254 insures proper frictional engagement between the surface vehicle and the tab 285 to prevent the vehicle's launching. Omitting the ramps results in insufficient friction; consequently, the arm 260 flexes so much that insufficient force is applied, enabling a surface vehicle to be launched despite interference with the tab. The ramps substantially eliminate any detrimental arm flexing.

Figure 3A:
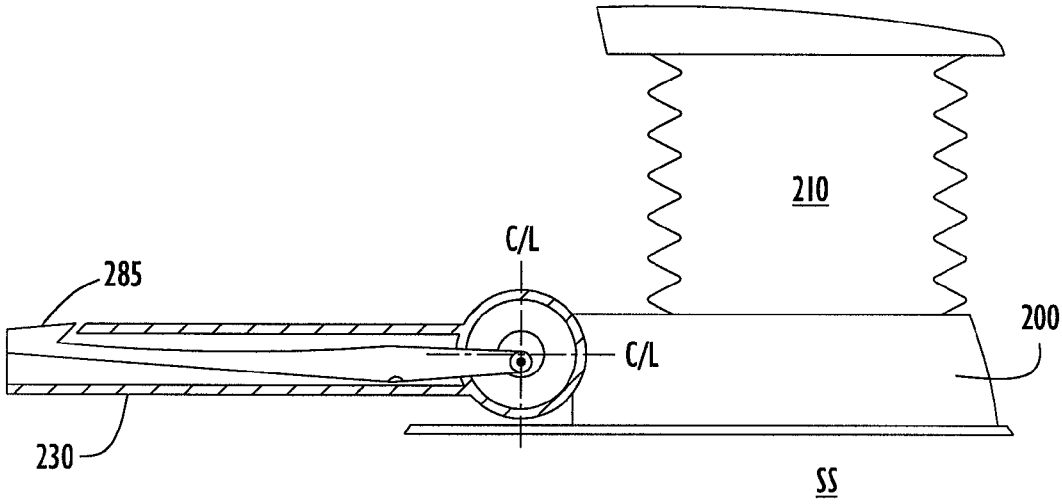
FIGS. 3A and 3B illustrate the operation of the interference mechanism, showing movement of the launch tube from a first position to a second position.
Figure 3B:
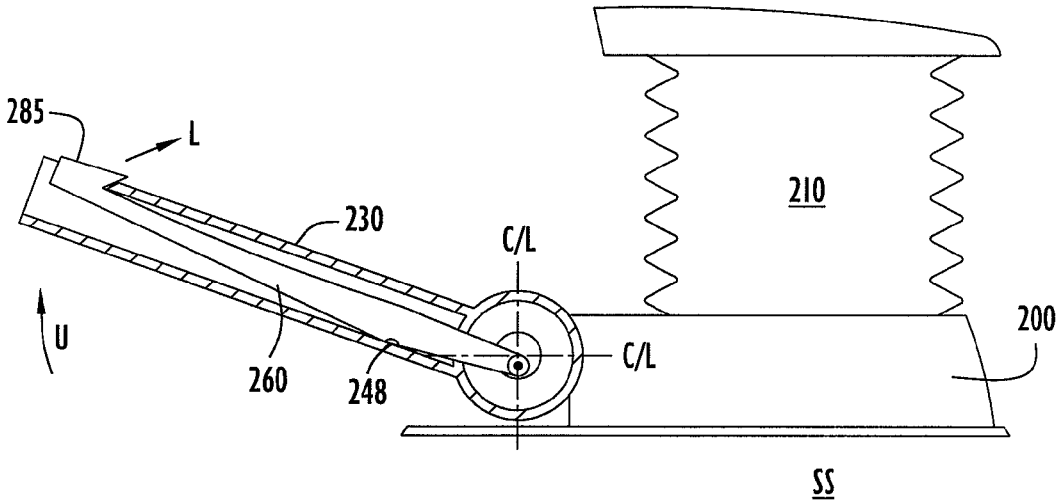
Figure 3C:
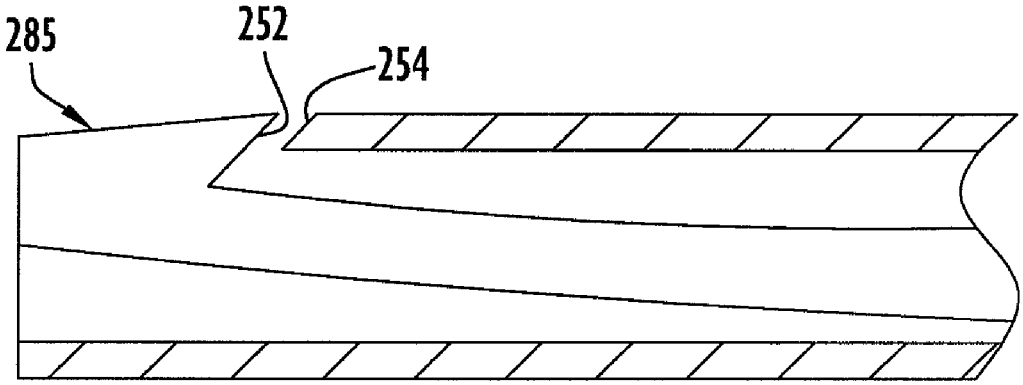
FIGS. 3C and 3D illustrate close-up, cross-section views of the distal end of the launch tube, showing the interference tab in retracted and extending positions.
Figure 3D:
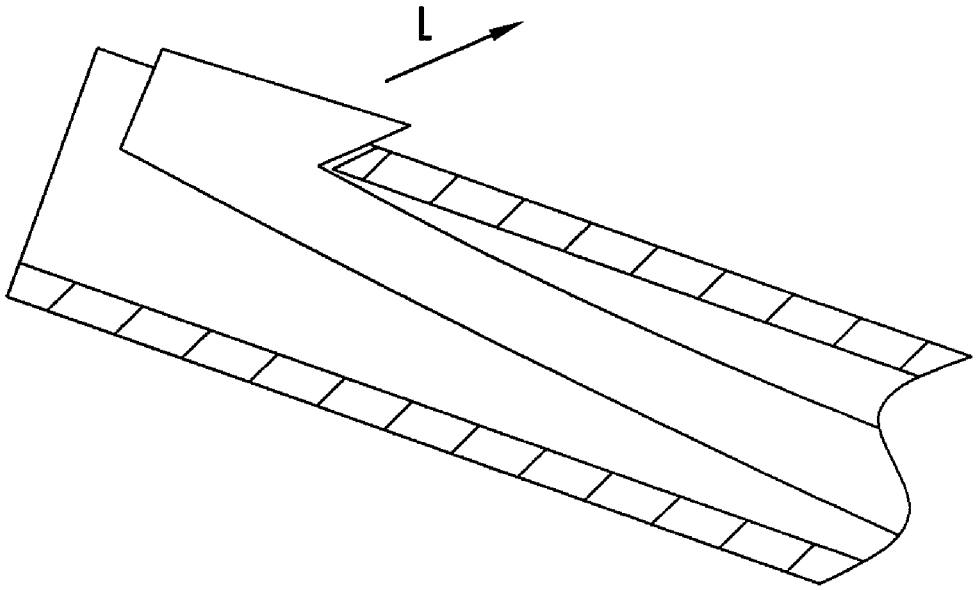

Operation of the launch tube 230 is explained with respect to FIGS. 3A and 3B. The launch tube 230 begins in its first position (FIG. 3A), with the launch tube 230 oriented in a generally horizontal position with respect to the support surface SS. In this position, the arm 260 is positioned within the launch tube 230 such that the tab 285 is generally flush with the outer surface of the launch tube 230. Rotating the launch tube 230 upward (indicated by arrow U) from the first position to the second position (FIG. 3B) not only reorients the launch tube 230 with respect to the base 200 and the support surface SS, but also reorients the arm 260 within the launch tube 230. Thus, in the second position, the launch tube 230 is positioned at an angle with respect to the supporting surface SS, and the tab 285 now extends radially outward from the launch tube 230, protruding from the notch 255. Thus, rotating the launch tube 230 from the first position to the second position reorients the tab 285 from a retracted position (FIG. 3A) to an extended position (FIG. 3B). This mechanism selectively prevents the mounting of certain of the accessory vehicles 110, 120 onto the launch tube 230 (discussed in greater detail below).

Figure 4A:
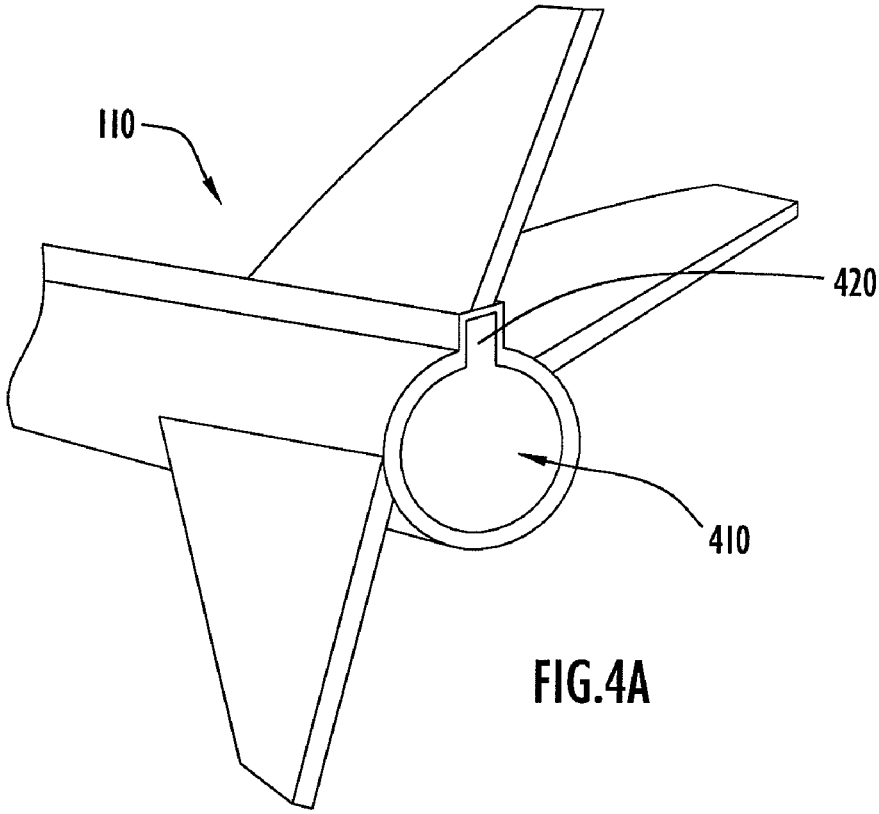
FIGS. 4A and 4B illustrate rear views of accessory vehicles, showing launch tube connection ports in accordance with embodiments of the invention.
Figure 4B:
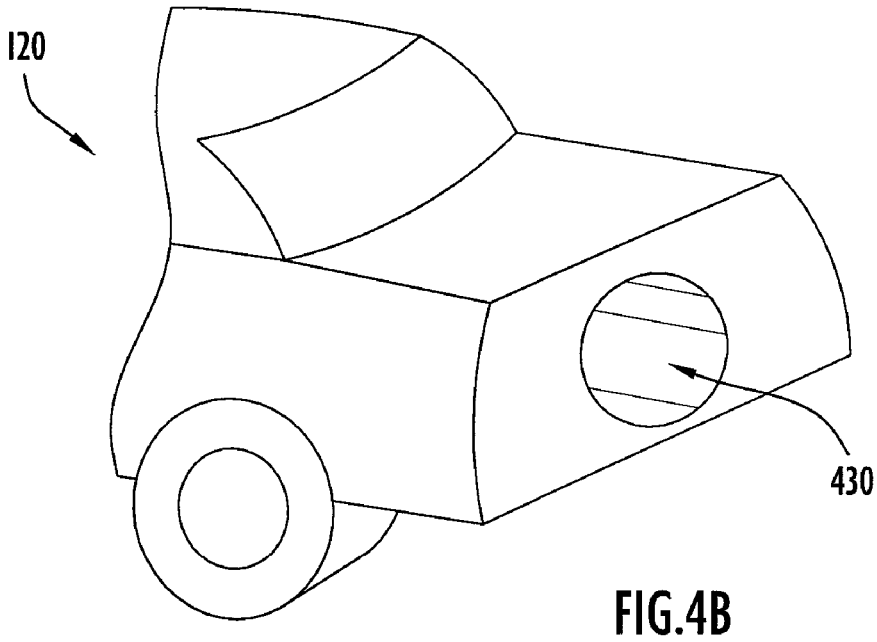

As mentioned above, the accessory vehicles, which are adapted to mount onto the launch tube 230, may include air vehicles 110 and surface vehicles 120. The air vehicles 110 may include any vehicle adapted to fly through the air (e.g., planes, jets, helicopters, space ships, etc.), while the surface vehicles 120 may include any vehicle adapted to travel along a surface (e.g., wheeled/rolling vehicles such as cars, trucks, other wheeled vehicles, etc.). FIGS. 4A and 4B are partial, rear perspective views of the air vehicle 110 and the surface vehicle 120, respectively. Each vehicle 110, 120 may include a connection port defined by a cylinder having a closed end and an open end. The port may be generally contoured to match the exterior surface of the launch tube 230; moreover, each port may be adapted to selectively receive the launch tube depending on whether the launch tube 230 is oriented in its first (horizontal) position or in its second (angled) position. Referring to FIG. 4A, the air vehicle 110 (FIG. 4A) may include a port 410 having a slot 420 configured to receive the launch tube 230 oriented in the second (non horizontal) position, with the interference tab 285 extended such that the tab is axially inserted into the slot 420. Referring to FIG. 4B, the surface vehicle 120 (FIG. 4B) may include a port 430 configured to receive the launch tube 230 only when it is oriented in the first (horizontal) position. In other words, the air vehicle 110 may be adapted to receive the launch tube 230 when the tab 285 of the arm 260 protrudes through the notch 255, in that it fits into the slot 420. The surface vehicle 120, in contrast, may only receive the launch tube 230 when the tab 285 is retracted, because if the tab is extended, it will hit the edge of port 430, preventing the port 430 from fitting on the launch tube. In this manner, the slotted port 410/420 permits the mounting of a vehicle on the angled launch tube 230, while the non-slotted port 430 does not.

To summarize, the above configuration may provide a launch tube 230 including an interference tab 285 disposed on a pivoting arm 260. The interference tab 285 may protrude out of the notch 255 near the distal end 250 of the launch tube 230 only when the launch tube 230 is angled above the horizontal. This configuration prevents vehicles with no slot, such as surface vehicles 120, which are often heavier and made of a more rigid material, from being mounted on the launch tube 230 and launched into the air. This, in turn, reduces the risk of injury to a child. When the launch tube 230 is lowered to the horizontal position, however, the tab 285 retracts inside the launch tube so the surface vehicle 120 again fits on the tube.

This configuration provides a safety mechanism. When the launch tube 230 is in the down/horizontal position, the tab 285 is down, so heavier surface vehicles 120 can fit on the tube. When the launch tube 230 is raised, the tab 285 is also raised and exposed, so that the heavier surface vehicles 120 no longer fit. However, a lighter, air vehicle 110 (like a plane) can be adapted to fit over the tab 285 and be launched. In addition, the arm 260 and the tab 285 partially block the channel of the launch tube 230, preventing a child from inserting an object (e.g., a pen or pencil) into the launch tube in an effort to launch the object.

Figure 5:
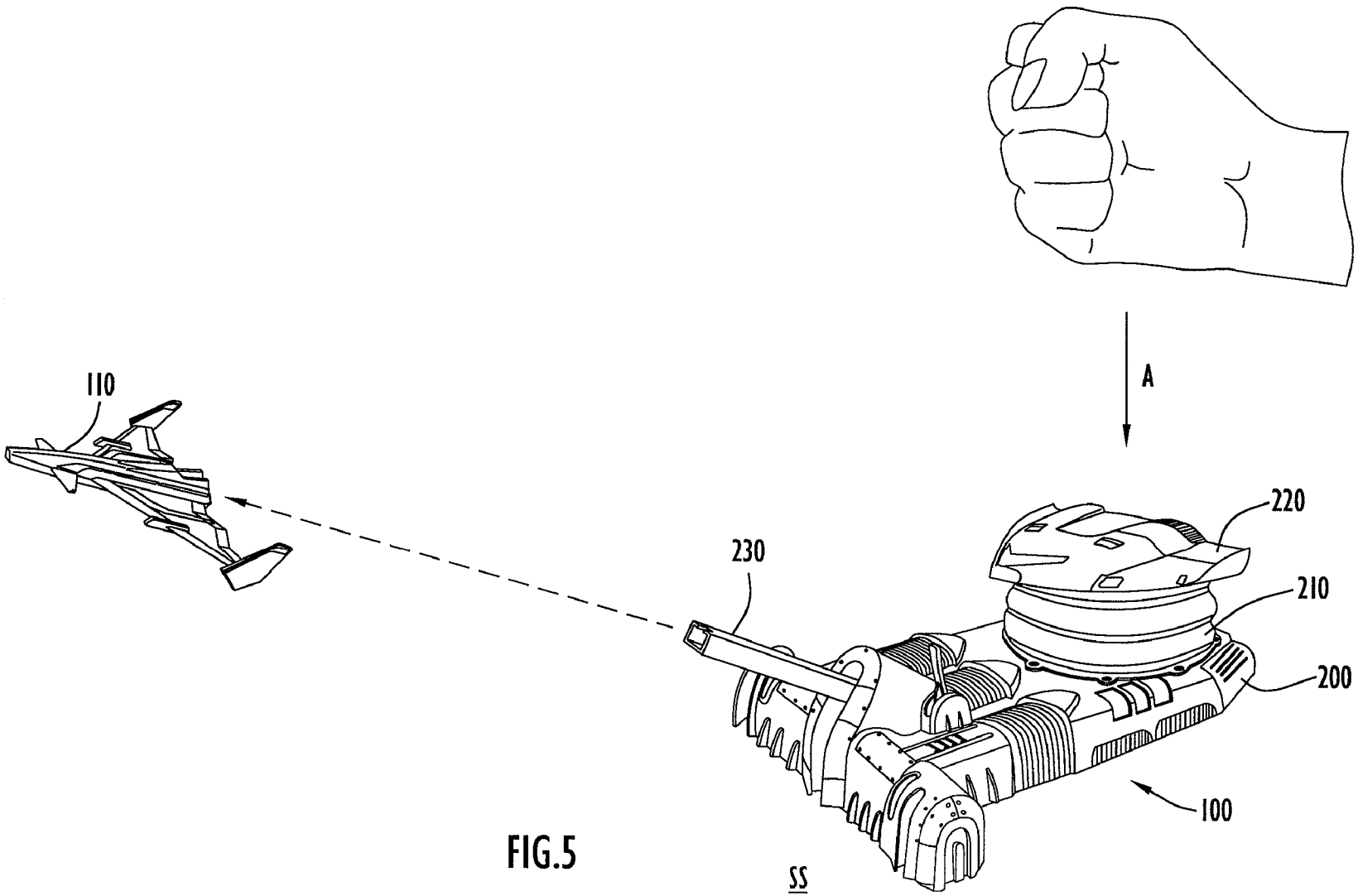
FIG. 5 illustrates the operation of the playset of FIG. 1.

The operation of the launching device 100 is explained with reference to FIG. 5. The launching tube 230 is positioned in either its first or second position. The connection port 410, 430 of the air or surface vehicle 110, 120 is aligned with the launch tube 230, and the launch tube 230 is axially urged into the connection port 410, 430. For example, in the embodiment of FIG. 5, the launch tube 230 is oriented in its second (angled) position, with an air vehicle 110 mounted thereon. The bellows 210 is compressed by depressing it toward the base 200 (indicated by arrow A). The air generated by the bellows 210 is forced through the base and into the launch tube 230 as described above. The airflow provides motive force to the vehicle 110, 120, propelling the vehicle off of the end of the launch tube 230. Depending on the orientation of the tube 230, the air either propels the vehicle 110, 120 into the air or along a surface (i.e., an air vehicle 110 becomes airborne, or a surface vehicle 120 travels along the supporting surface SS). Specifically, when the launch tube 230 is oriented in the first position, the surface vehicle 120 connects to the launch tube 230, and is propelled along the supporting surface SS. When the launch tube 230 is oriented in the second position, only the air vehicle 110 may be mounted onto the launch tube 230, and the vehicle 110 is propelled into the air.

Figure 6A:
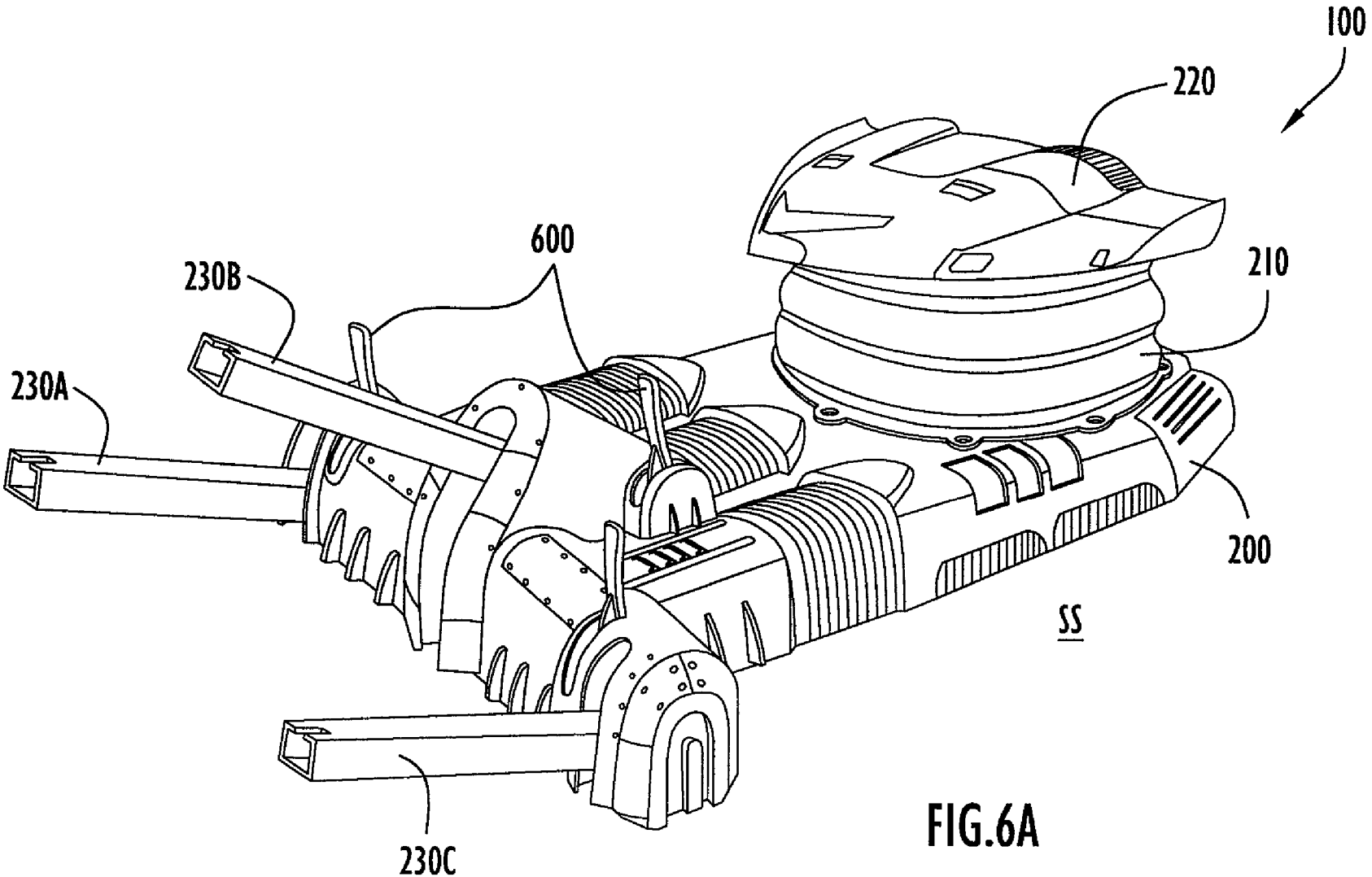
FIGS. 6A and 6B illustrate a launching device in accordance with another embodiment of the invention and its operation.
Figure 6B:
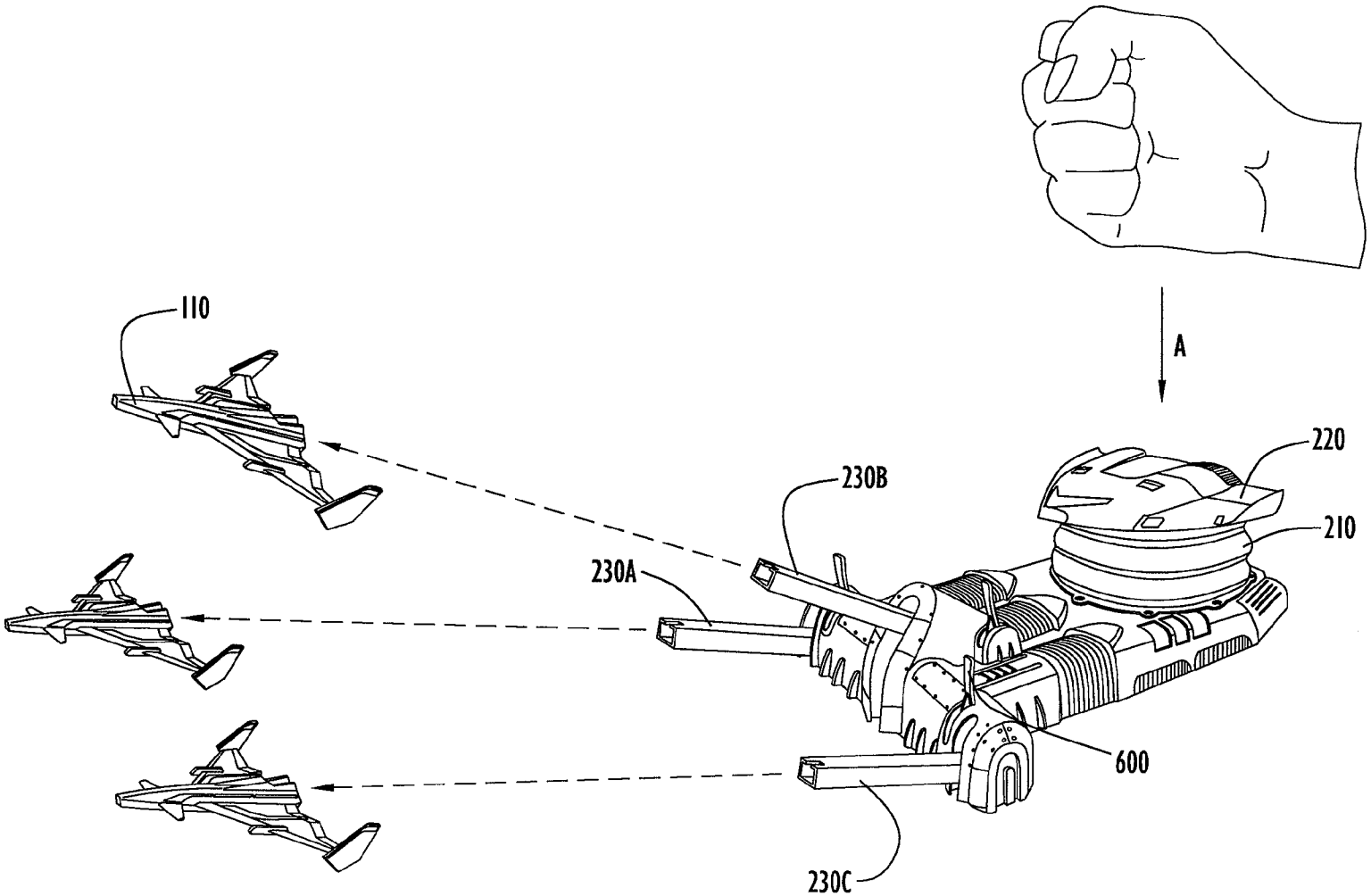

FIGS. 6A and 6B illustrate a launching device 100 in accordance with another embodiment of the invention. As shown, the launching device 100 may include multiple launch tubes 230A, 230B, 230C, each operable to be selectively oriented in either the first (horizontal) or second (non-horizontal) positions (e.g., via a levers 600). As a result, an accessory vehicle 110, 120 may be mounted onto each launch tube 230A, 230B, 230C and, as shown in FIG. 6B, launched by depressing bellows 210 in a manner similar to that described above. With this configuration, the launching device 100 may selectively and/or simultaneously launch air vehicles 110 and/or surface vehicles 120 into the air or along the supporting surface SS. Thus, the device 100 can also be expanded to have multiple launch tubes powered by the same bellows 210, for racing multiple vehicles 110, 120, or for launching a larger vehicle configured with a plurality of ports 410, 430 (e.g., a dual-engine jet plane) (not illustrated).

Figure 7A:
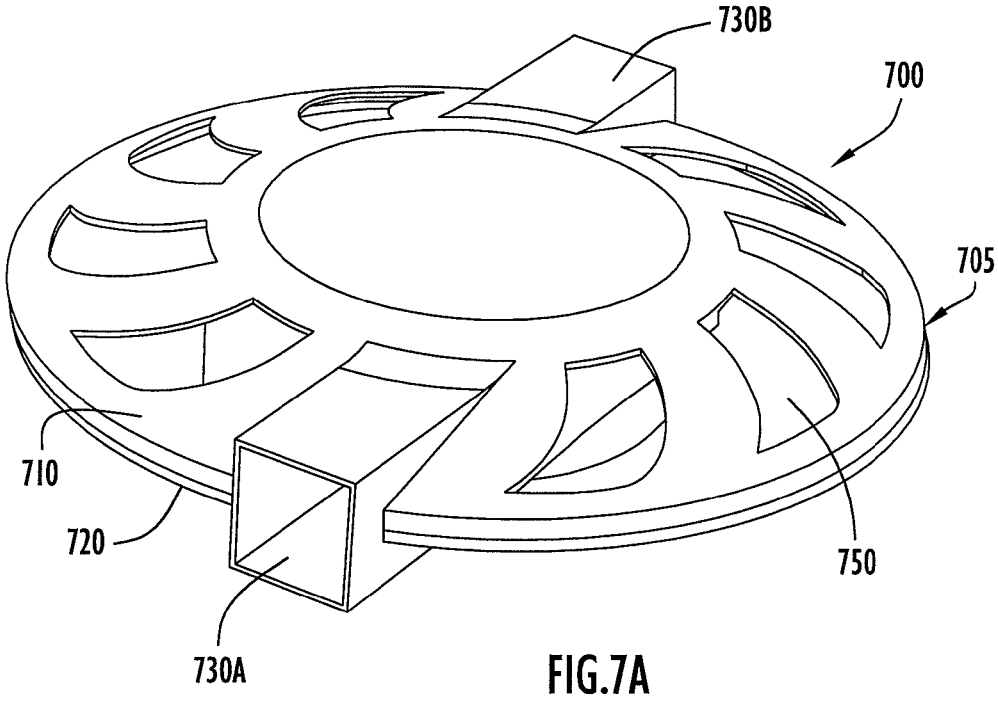
FIGS. 7A and 7B are perspective and top views of an accessory vehicle in accordance with an embodiment of the invention.
Figure 7B:
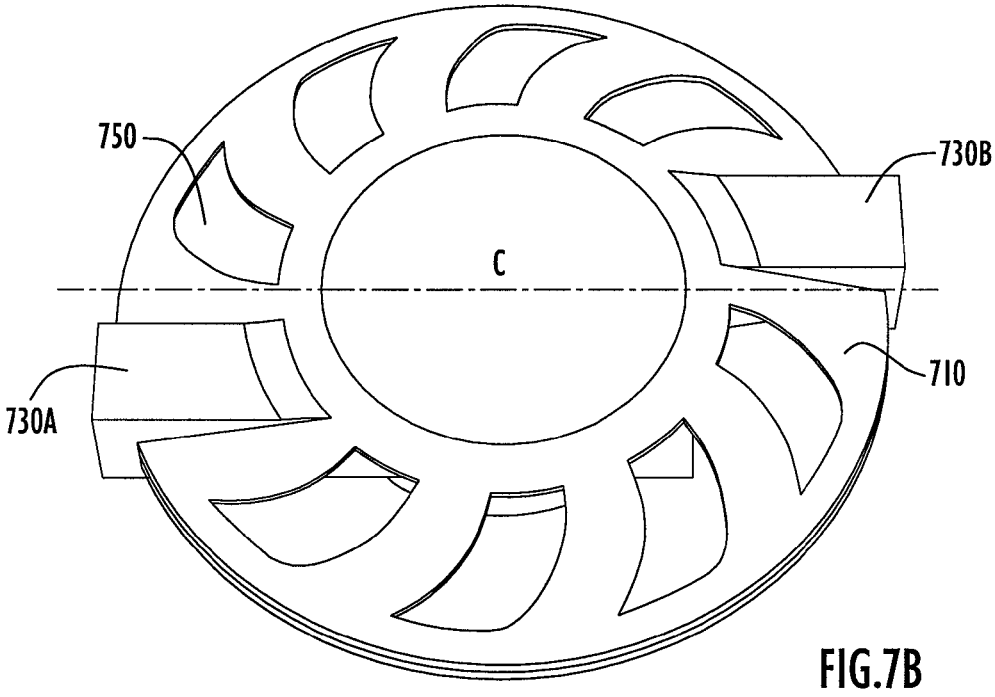

Another accessory vehicle in accordance with an embodiment of the invention is illustrated in FIGS. 7A and 7B. As shown, the vehicle 700 may be stylized as a space saucer and configured for rotary motion upon being launched by the launching device 100. The saucer vehicle 700 may be in the form of a disk including a body 705 having an upper portion 710 and a lower portion 720. The body 705 may further include at least one connection port positioned to provide an eccentric weight to the body and initiate rotary motion. For example, the body may include a pair of offset connection ports. Specifically, the body 705 may include a first connection port 730A and a second connection port 730B. As with the connection ports described above, the saucer vehicle connection ports 730A, 730B may be defined by a cylinder configured to receive a launching tube 230, and having an opened end and closed end. Each port 730A, 730B may be positioned on the body 705 such that they are symmetrically disposed on opposite sides of the centerline or diameter line C of the body 705. Alternatively, one port may be provided, being disposed proximate one side of the centerline C. Utilizing a single port also provides sufficient eccentric force to cause rotary motion in the saucer vehicle 700 when launched from a lunching device 100.

With this configuration, when the saucer vehicle 700 is launched from the launching device 100, an eccentric force is created, causing the saucer vehicle 700 to spin. The spinning, in turn, stabilizes the saucer vehicle 700 as it travels (e.g., as it skims across a supporting surface). The body 705 may further include one or more vents 750 formed into its upper 710 and/or lower 720 portions.

Figure 8A:
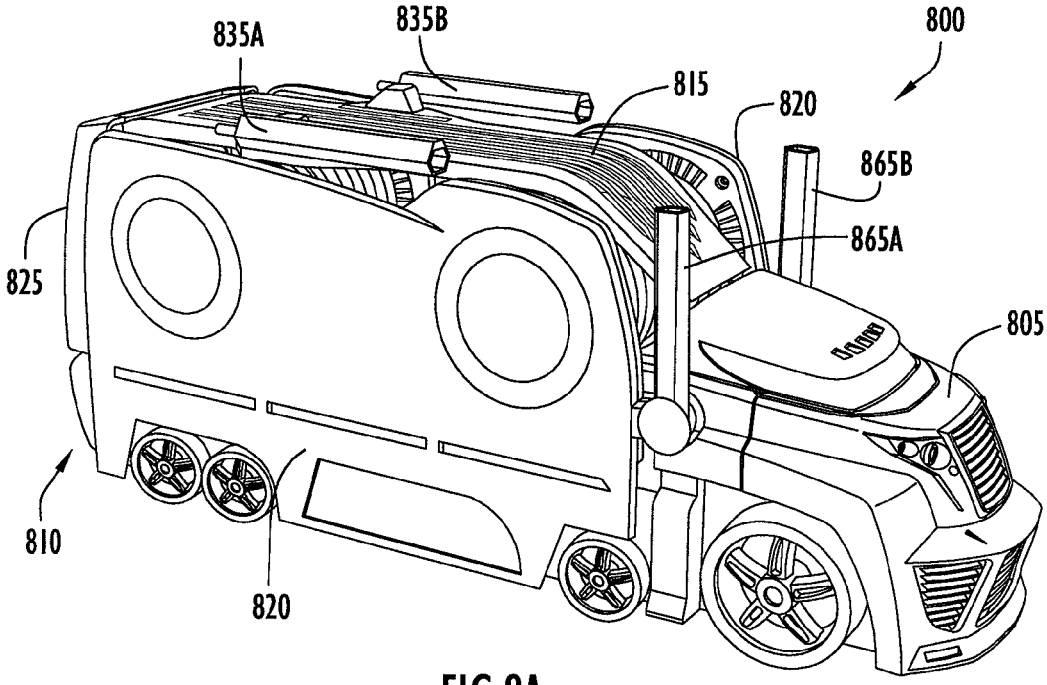
FIGS. 8A-8C illustrate a playset in accordance with another embodiment of the invention, showing a launching device mounted onto a toy transport vehicle. Specifically.
Figure 8C:
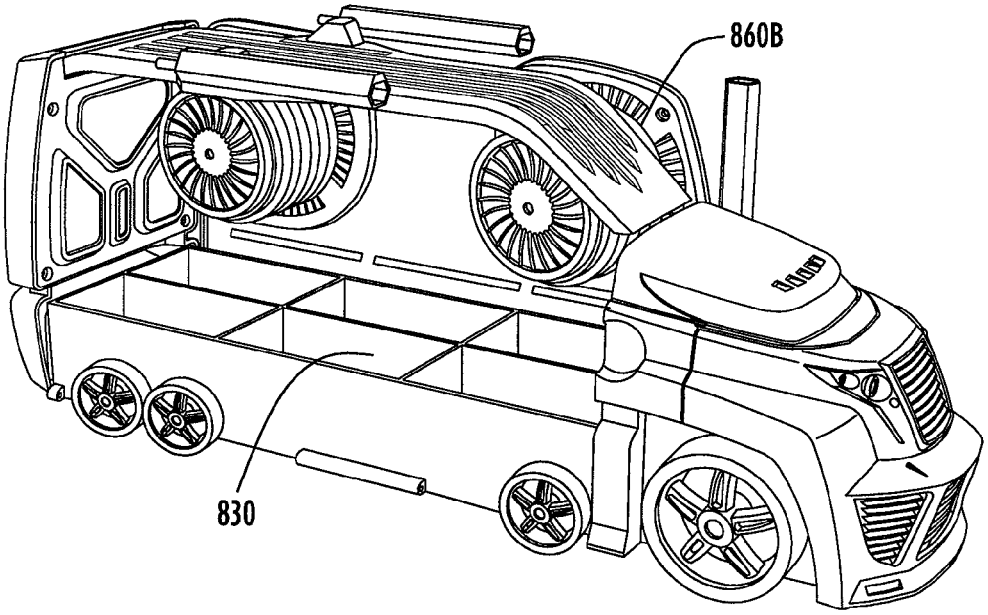
Figure 8B:
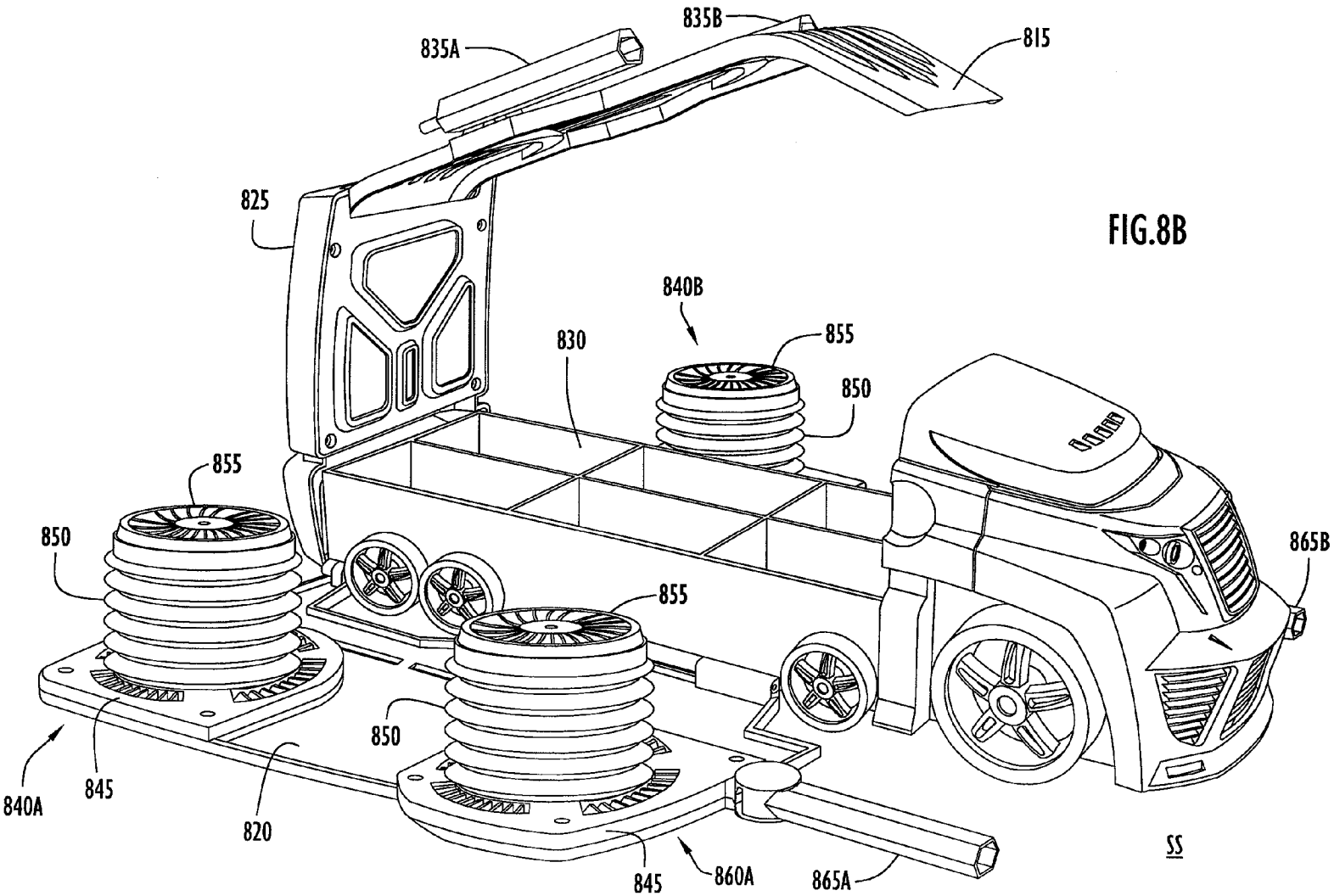

FIGS. 8A-8C illustrate a playset in accordance with another embodiment of the invention, wherein the launching device 100 is integrated into a carrying case (not shown) or a large vehicle (called a transport vehicle). In the illustrated embodiment, the playset includes a transport vehicle 800 including a cab 805 and a trailer 810 with a top wall or panel 815, side walls 820, and a rear wall or panel 825. The side walls 820 may be pivotally connected to the chassis 830 of the trailer 810, thus may be reoriented from a closed position (FIG. 8A) to an opened position (FIG. 8B). Similarly, the top panel 815 may be pivotally coupled to the back panel 825. The top panel 815 may include one or more launch tubes 835A, 835B in fluid communication with one or more air vehicle launching devices 840A, 840B disposed on the interior surface of the side walls 820. The launching devices 840A, 840B may include a base 845, bellows 850, and a cap 855 similar to that described above (FIG. 2). The top panel launch tubes 835A, 835B may be configured to launch air vehicles 110, thus they may include the interference tab 285 permanently oriented in the extending/protruding position (not illustrated). Alternatively, the interference tab 285 of the top panel launch tubes 835A, 835B may be configured to retract and protrude as the top panel 815 is moved from a generally horizontal position to an angled position. The top panel launch tubes 835A, 835B may be in fluid communication with the bellows 850 via a conduit or hose disposed within the rear panel 825.

The transport vehicle 800 may further include surface vehicle launching devices 860A, 860B mounted onto the side walls 820. Similar to the air vehicle launching devices 840A, 840B, the surface vehicle launching devices 860A, 860B may include a base 845, bellows 850, and a cap 855. The surface vehicle launching devices 860A, 860B further include surface launching tubes 865A, 865B oriented such that surface vehicles 120 may be propelled along a supporting surface SS. The surface vehicle launching tubes 865A, 865B may be adapted to rotate from a storage position (FIG. 8A) to a deployed position (FIG. 8B).

In operation, with the transport vehicle 800 beginning in its storage position (FIG. 8A), the side walls 820 are folded downward, onto the supporting surface SS. The surface vehicle tubes 865A, 865B are rotated outward from its storage position to its deployed position as described above. The upper panel 815, moreover, is pivoted upward from its storage (horizontal) position to its deployed (angled) position. A user may then selectively mount air vehicles 110 onto the top panel launch tubes 835A, 835B, launching the air vehicles 110 by engaging air vehicle launching devices 840A, 840B. Alternatively or in addition to, the user may mount surface vehicles 120 onto the surface launch tubes 865A, 865B, engaging the surface vehicle launching devices 860A, 865B to launch the surface vehicle 120.

When a user is finished using the product, the side walls 820 are folded upward, from their deployed position to their storage position. Similarly, the surface launch tubes 865A, 865B are folded from their deployed position to their storage position. Finally, the top panel 815 is folded downward, from the deployed position to the storage position.

While the invention has been described in detail and with reference to specific embodiments thereof, it will be apparent to one skilled in the art that various changes and modifications can be made therein without departing from the spirit and scope thereof. For example, in addition to vehicles, the launching device 100 may be configured to launch other toy accessories including the appropriate launch tube connection port. By way of example, the toy accessories may include other projectile devices such as missiles, rockets, toy figures, etc, as well any other wheeled or non-wheeled vehicles.

The launching device 100 and launching tube 230 may possess any suitable shape or have any suitable dimensions. The pressurized fluid flow may be provided by any suitable pressurized fluid device. The surface vehicle ports 430 may include any port operable to restrict the mounting of the surface vehicle 120 onto the launch tube 230 (when the launch tube 230 is in a raised position). For example, instead of providing the air vehicles 110 with a slotted port 410/420, the surface vehicles 120 may have a port 430 with a diameter that is smaller than the air vehicle port 410 so that when the tab 285 protrudes from the notch 255, the surface vehicle 120 can not be mounted onto the launch tube 230 because of interference with the tab 285. In addition, the air vehicles 110 may have a differently shaped and/or larger cylinder that fits closely around the launch tube 230 and the extended interference tab 285 so they can be launched upward at an angle.

Thus, it is intended that the present invention cover the modifications and variations of this invention that come within the scope of the appended claims and their equivalents. It is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

I claim:

1. A playset for toy accessories comprising:

a toy accessory launching device including:

a fluid flow assembly operable to generate a flow of fluid, a launch tube in fluid communication with the fluid flow assembly, and an interference mechanism including an interference arm at least partially disposed within the launch tube, the interference arm being configured to move with respect to the launch tube; and a toy accessory including a connection port configured to slidingly receive the launch tube, wherein the interference mechanism moves from a first position, in which movement between the launch tube and the toy accessory is permitted, to a second position, in which movement between the launch tube and the toy accessory is restricted.

2. The playset of claim 1, wherein the fluid flow assembly comprises a pneumatic assembly operable to generate a flow of air.

3. The playset of claim 1, wherein the interference mechanism selectively limits:

the mounting of the accessory vehicle onto the launch tube; and the launching of the toy accessory mounted on the launch tube.

4. The playset of claim 1, wherein:

the launch tube comprises a proximal tube end and a distal tube end;

the interference arm includes:

a proximal end coupled to the launching device, and a distal end including a tab member; and the launch tube moves from a first position, in which the tab member is retracted within the launch tube, to a second position, in which the tab member extends out of the tube.

5. The playset of claim 4, wherein:

the distal tube end comprises a notch defining an open area on the launch tube;

the notch includes a ramp; and the tab member includes a shoulder that engages the tube ramp when the launch tube is oriented in its second position.

6. The playset of claim 1, wherein:

the launch tube is moveably coupled to the launching device;

the interference arm is moveably coupled to the launching device; and moving the launch tube causes a corresponding motion in the interference arm.

7. The playset of claim 1, wherein:

the launch tube moves about a first pivot point;

the interference arm is at least partially disposed within the launch tube; and the interference arm moves about a second pivot point different from the first pivot point.

8. The playset of claim 7, wherein pivoting the launch tube about the first pivot point causes a corresponding pivot in the interference arm about the second pivot point.

9. The playset of claim 1, wherein:

the launch tube comprises a proximal tube end and a distal tube end;

the interference arm includes:

a proximal end coupled to the launching device, and a distal end including a tab member;

the launch tube moves from a first tube position, in which the tab member is retracted within the launch tube, to a second tube position, in which the tab member extends out of the launch tube; and the toy accessory comprises a plurality of accessory toys including a first accessory toy having a first connection port configuration and a second accessory toy having a second connection port configuration, wherein the first connection port configuration receives the tube in the first tube position and the second port configuration receives the tube in the second tube position.

10. The playset of claim 9, wherein the extended tab member prevents at least one of:

the mounting of the first accessory toy onto the launch tube when the launch tube is disposed in the second tube position; and the launching of the first accessory toy mounted on the launch tube when the launch tube is disposed in the second tube position.

11. The playset of claim 1, wherein the launching device is mounted on a toy transport vehicle or a carrying case, the transport vehicle or carrying case including foldable portions.

12. A playset for toy accessories comprising:

a toy accessory launching device including:

a fluid flow assembly operable to generate a flow of fluid, a launch tube in fluid communication with the fluid flow assembly, the launch tube is movably coupled to the launching device, and an interference mechanism including an interference arm movably coupled to the launching device, and moving the launch tube causes a corresponding motion in the interference arm; and a toy accessory including a connection port configured to slidingly receive the launch tube, wherein the interference mechanism moves from a first position, in which movement between the launch tube and the toy accessory is permitted, to a second position, in which movement between the launch tube and the toy accessory is restricted.

13. The playset of claim 12, wherein the fluid flow assembly comprises a pneumatic assembly operable to generate a flow of air.

14. The playset of claim 12, wherein the interference mechanism selectively limits:

the mounting of the accessory vehicle onto the launch tube; and the launching of the toy accessory mounted on the launch tube.

15. The playset of claim 12, wherein the interference aim is at least partially disposed within the tube, the interference arm being configured to move with respect to the launch tube.

16. The playset of claim 15, wherein:

the launch tube comprises a proximal tube end and a distal tube end;

the interference arm includes:

a proximal end coupled to the launching device, and a distal end including a tab member; and the launch tube moves from a first position, in which the tab member is retracted within the launch tube, to a second position, in which the tab member extends out of the tube.

17. The playset of claim 16, wherein:

the distal tube end comprises a notch defining an open area on the launch tube;

the notch includes a ramp; and the tab member includes a shoulder that engages the tube ramp when the launch tube is oriented in its second position.

18. The playset of claim 12, wherein:

the launch tube moves about a first pivot point;

the interference arm is at least partially disposed within the launch tube; and the interference arm moves about a second pivot point different from the first pivot point.

19. The playset of claim 18, wherein pivoting the launch tube about the first pivot point causes a corresponding pivot in the interference arm about the second pivot point.

* * * * *